US008394562B2

(12) United States Patent
Veregin et al.

(10) Patent No.: US 8,394,562 B2
(45) Date of Patent: Mar. 12, 2013

(54) TONER COMPOSITIONS

(75) Inventors: Richard P. N. Veregin, Mississauga (CA); Eric Rotberg, Toronto (CA); Michael S. Hawkins, Cambridge (CA); Cuong Vong, Hamilton (CA); Jordan H. Wosnick, Toronto (CA)

(73) Assignee: Xerox Corporation, Norwalk, CT (US)

( * ) Notice: Subject to any disclaimer, the term of this patent is extended or adjusted under 35 U.S.C. 154(b) by 733 days.

(21) Appl. No.: 12/493,473

(22) Filed: Jun. 29, 2009

(65) Prior Publication Data

US 2010/0330487 A1 Dec. 30, 2010

(51) Int. Cl.
*G03G 9/09* (2006.01)

(52) U.S. Cl. ..... 430/108.1; 430/108.6; 430/108.7; 430/110.2

(58) Field of Classification Search ..... 430/110.2, 430/108.1, 108.6, 108.7
See application file for complete search history.

(56) References Cited

U.S. PATENT DOCUMENTS

| | | | | |
|---|---|---|---|---|
| 3,590,000 | A | 6/1971 | Palermiti et al. | |
| 3,655,374 | A | 4/1972 | Palermiti et al. | |
| 3,674,736 | A | 7/1972 | Lerman et al. | |
| 3,720,617 | A | 3/1973 | Chatterji et al. | |
| 3,847,604 | A | 11/1974 | Hagenbach et al. | |
| 3,944,493 | A | 3/1976 | Jadwin et al. | |
| 3,983,045 | A | 9/1976 | Jugle et al. | |
| 4,295,990 | A | 10/1981 | Verbeek et al. | |
| 4,659,640 | A * | 4/1987 | Santilli | 430/117.5 |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,290,654 | A | 3/1994 | Sacripante et al. | |
| 5,330,874 | A | 7/1994 | Mahabadi et al. | |
| 5,763,130 | A * | 6/1998 | Sasaki et al. | 430/110.2 |
| 6,004,714 | A | 12/1999 | Ciccarelli et al. | |
| 6,063,827 | A | 5/2000 | Sacripante et al. | |
| 6,190,815 | B1 | 2/2001 | Ciccarelli et al. | |
| 6,593,049 | B1 | 7/2003 | Veregin et al. | |
| 6,713,222 | B2 | 3/2004 | Sacripante et al. | |
| 6,756,176 | B2 | 6/2004 | Stegamat et al. | |
| 6,764,799 | B2 | 7/2004 | Skorokhod et al. | |
| 6,830,860 | B2 | 12/2004 | Sacripante et al. | |
| 7,507,513 | B2 | 3/2009 | Tong et al. | |
| 7,507,515 | B2 | 3/2009 | Winters | |
| 7,507,517 | B2 | 3/2009 | Wolfe et al. | |
| 2003/0054277 | A1 | 3/2003 | Fujikura | |
| 2006/0222991 | A1 | 10/2006 | Sacripante et al. | |
| 2008/0193869 | A1 | 8/2008 | Vanbesien et al. | |
| 2008/0248413 | A1 | 10/2008 | Ishii et al. | |
| 2009/0059252 | A1 | 3/2009 | Coyle et al. | |

FOREIGN PATENT DOCUMENTS

| | | | | |
|---|---|---|---|---|
| EP | 1 975 729 | A1 | | 10/2008 |
| JP | 2007017719 | A | * | 1/2007 |
| KR | 2006004512 | A | * | 1/2006 |
| WO | WO 2008038733 | A1 | * | 4/2008 |

OTHER PUBLICATIONS

Qi et al., "Synthesis and characterization of ZnS:Cu,Al phosphor prepared by a chemical solution method", Journal of Luminescence 104 (2003) pp. 261-266.*

English language machine translation of JP 2007-017719 (Jan. 2007).*

English language machine translation of KR 2006-0004512 (Jan. 2006).*

European Search Report dated Oct. 20, 2010 for copending European application No. 10166279.9.

* cited by examiner

*Primary Examiner* — Christopher Rodee
(74) *Attorney, Agent, or Firm* — Judith L. Byorick

(57) ABSTRACT

Coated phosphorescent pigments are provided which may be utilized in toner compositions. In embodiments, the phosphorescent pigment may be coated by a powder coating process. The large pigment particles may be dry blended with dried resin latex particles, thereby coating the pigment surface, followed by heating and shearing in a rotary kiln or extruder to melt the toner resin and fuse it to the pigment surface. The resulting coated particles may be utilized with other toners, in embodiments color toners, to provide phosphorescent images.

20 Claims, No Drawings

TONER COMPOSITIONS

BACKGROUND

The present disclosure is generally directed to toner processes and, more specifically, to preparation of toner compositions having phosphorescent components which may be useful for document security.

Fluorescent inks and dyes may be used as an authenticating feature in the document security industry. Secure documents, for example documents that are difficult to forge, may be conventionally created using inks that include fluorescent agents either alone or in combination with ordinary inks and/or pigments. Features printed using fluorescent inks are usually invisible under visible light, due to the colorless nature of the security inks or due to masking by other colorants in the document. Under ultraviolet illumination, however, the fluorescent features of the document are revealed in the form of a bright emission by the fluorescent dyes in the visible spectrum. For example, certain bank notes utilize visible features, such as holographic patches, microprinting and microtextures to conceal additional fluorescent threads and/or multi-colored emblems embedded in the bank note, which are only revealed under specific light frequencies. These features provide an increased level of security against counterfeiters by making the copying process of such a document more difficult.

A phosphorescent image may similarly be useful in electrophotographic applications, including for security and special effects. Phosphorescence is a type of photoluminescence related to fluorescence, but unlike fluorescence, a phosphorescent material does not immediately re-emit the radiation it absorbs. Such a phosphorescent image would continue to emit light after external light sources were removed, which is not possible with fluorescent materials.

While commercial phosphorescent pigments exist, they are too large to be incorporated into toner particles, as median pigment sizes range from 5 to >50 microns, similar in size or larger than the toner. This fundamental limitation is due to a key physical principle: large particle size pigments are needed to maintain the phosphorescent material properties. Both chemical and conventional toner processes currently available will fail to incorporate these large pigments. Thus, it is currently not possible to incorporate such large pigment particles in an emulsion aggregation (EA) toner process.

Also, while it is possible to melt-mix pigment particles with a toner resin, due to the large size of the phosphorescent pigment, even if the toner were 20 or 30 microns in size, the pigment particles would make up the bulk of the toner. For example, a 35 micron toner with one 20 micron pigment particle would have a pigment loading of about 40%. Thus, it would be extremely difficult to jet such large toner particles having such a high pigment loading. Also, with such a large pigment, even a 20 to 30 micron toner would only have a few pigment particles in each toner particle. Statistically, the toner would be very inhomogeneous; many particles would have no pigment particle in them, while others would have one or perhaps two or three pigment particles. Thus, to date it has not been possible to directly prepare phosphorescent electrophotographic prints.

Methods for producing phosphorescent toners which are suitable for use in creating electrophotographic prints thus remain desirable.

SUMMARY

The present disclosure provides toners and processes for the preparation of particles having phosphorescent characteristics. In embodiments, a toner of the present disclosure may include a phosphorescent pigment particle having a size of from about 5 microns to about 50 microns; a resin coating on at least a portion of a surface of the phosphorescent pigment; and optionally a surface additive on at least a portion of the resin coating, wherein the phosphorescent pigment has an excitation wavelength of from about 200 nm to about 750 nm.

In yet other embodiments, a toner of the present disclosure may include a phosphorescent pigment particle having a size of from about 5 microns to about 50 microns; a resin including an amorphous polyester, optionally in combination with a crystalline polyester, as a coating on at least a portion of a surface of the phosphorescent pigment; and optionally a surface additive on at least a portion of the resin coating, wherein the phosphorescent pigment has an excitation wavelength of from about 200 nm to about 750 nm.

In yet other embodiments, a toner of the present disclosure may include a phosphorescent pigment particle having a size of from about 10 microns to about 40 microns; a resin including an amorphous polyester, optionally in combination with a crystalline polyester, as a coating on at least a portion of a surface of the phosphorescent pigment; and optionally a surface additive on at least a portion of the resin coating, wherein the phosphorescent pigment has an excitation wavelength of from about 200 nm to about 750 nm.

DETAILED DESCRIPTION

The present disclosure provides toners and processes for the preparation of particles having phosphorescent characteristics. While the phosphorescent pigments coated with resins in accordance with the present disclosure are coated pigment particles, they may be referred to, in embodiments, as phosphorescent toners. The phosphorescent toners of the present disclosure may, in embodiments, include a phosphorescent agent for security, artistic, and low-lighting applications.

In accordance with the present disclosure, large phosphorescent pigment particles (from about 5 microns to more than about 50 microns in size) may be coated by a powder coating process. The large pigment particles may be dry blended with dried resin latex particles, thereby coating the pigment surface, followed by heating and shearing in a rotary kiln or extruder to melt the toner resin and fuse it to the pigment surface.

Phosphorescent Pigment

Phosphorescent pigments for use in accordance with the present disclosure include any such pigments within the purview of those skilled in the art. Suitable pigments include, in embodiments, ZnS pigments, including ZnS optionally doped with Mn and/or Cu. Such ZnS pigments include ZnS doped with Cu such as 2330, which is commercially available from USR Optonix Inc. and is available in sizes of from about 12 microns to about 30 microns, and possesses a green glow, and $Sr_2MgSi_2O_7$, commercially available as P170 SPS BLUE from USR Optonix Inc., having a particle size of about 18 microns and a blue glow. Other examples of suitable phosphorescent pigments include alkaline earth aluminates and alkaline earth silicates. For example, a suitable alkaline earth aluminate includes LUMINOVA®, commercially available from Nemoto & Co., Ltd., which glows blue. Other suitable LUMINOVA® pigments, commercially available from Nemoto & Co., Ltd., include $SrAl_2O_4$ doped with Eu and Dy, such as those sold as G-300 having particle sizes of from about 2 to about 60 microns and those sold as GLL-300 having particle sizes of from about 2 to about 40 microns, $Sr_4Al_{14}O_{25}$ doped with Eu and Dy having particle sizes of from about 2 to about 40 microns, such as those sold as BG-300 and BGL-300, and $CaAl_2O_4$ doped with Eu and Nd having particle sizes of from about 20 to about 60 microns, such as those sold as V-300, or admixtures of pigments such as those sold as B-300, which includes $CaAl_2O_4$ doped with Eu and Nd combined with $Sr_4Al_{14}O_{25}$ doped with Eu and Dy. Also suitable are 14 micron NG-15 or 20 micron NG-20 ZnS doped with Cu, which glow yellow/orange; 18 micron NG-25 ZnS doped with Mn and Cu, which glows orange; 26 micron NGX-19 $Sr_2MgSi_2O7$ (doped with Dy and Eu) which glows blue; and 23 micron NGX-6Y $SrAl_2O_4$ (doped with Dy and Eu) which glows yellow green, all of which are commercially available from Dayglo.

Phosphorescent pigments may have a particle size of from about 5 microns to about 50 microns, in embodiments from about 10 microns to about 40 microns. In some embodiments, a commercial phosphorescent pigment which may be used is USR Optonix P170 SPS BLUE having particle size of about 18 microns.

Suitable phosphorescent pigments are desired to be lightfast, so that the phosphorescent brightness is degraded only slowly with time on exposure to light. Excellent lightfastness would drop the initial afterglow brightness by less than 20% after irradiation with 300 W high pressure mercury lamp in an accelerated aging test of 1000 hours exposure.

A suitable excitation wavelength for the phosphorescent pigment is from about 200 nm to about 750 nm, in embodiments from about 225 nm to about 450 nm. A suitable emission wavelength may be visible to the eye for visual applications, in embodiments from about 380 nm to about 750 nm.

Resins

Any latex resin may be utilized in forming a coating for a phosphorescent pigment of the present disclosure. Such resins, in turn, may be made of any suitable monomer. Any monomer employed may be selected depending upon the particular polymer to be utilized.

In embodiments, the resins may be an amorphous resin, a crystalline resin, and/or a combination thereof. In further embodiments, the polymer utilized to form the resin core may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly (pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), poly(propylene-succinimide), and poly (butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly (propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

(I)

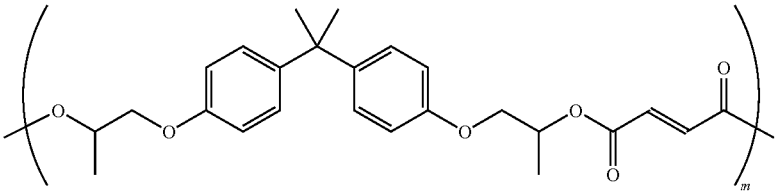

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

Suitable crystalline resins which may be utilized, optionally in combination with an amorphous resin as described above, include those disclosed in U.S. Patent Application Publication No. 2006/0222991, the disclosure of which is hereby incorporated by reference in its entirety. In embodiments, a suitable crystalline resin may include a resin formed of ethylene glycol and a mixture of dodecanedioic acid and fumaric acid co-monomers with the following formula:

(II)

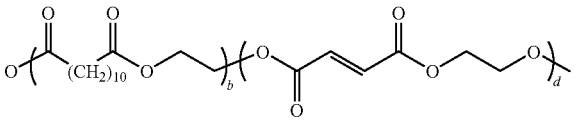

wherein b is from about 5 to about 2000 and d is from about 5 to about 2000.

In embodiments, a poly(propoxylated bisphenol A co-fumarate) resin of formula I as described above may be combined with a crystalline resin of formula II to form a resin suitable for use as a coating of a phosphorescent pigment.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

In other embodiments, the resin may be derived from the emulsion polymerization of monomers including, but not limited to, styrenes, butadienes, isoprenes, acrylates, methacrylates, acrylonitriles, acrylic acid, methacrylic acid, itaconic or beta carboxy ethyl acrylate (β-CEA) and the like.

In embodiments, the resin may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly (styrene-alkyl methacrylate), poly (styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and mixtures thereof. In embodiments, the polymer is poly (styrene/butyl acrylate/beta carboxyl ethyl acrylate). The polymer may be block, random, or alternating copolymers.

In embodiments, the latex may be prepared by a batch or a semicontinuous polymerization resulting in submicron non-crosslinked resin particles suspended in an aqueous phase containing a surfactant. Surfactants which may be utilized in the latex dispersion can be ionic or nonionic surfactants in an amount of from about 0.01 to about 15, and in embodiments of from about 0.01 to about 5 weight percent of the solids.

Anionic surfactants which may be utilized include sulfates and sulfonates such as sodium dodecylsulfate (SDS), sodium dodecyl benzene sulfonate, sodium dodecylnaphthalene sulfate, dialkyl benzenealkyl sulfates and sulfonates, abitic acid, and the NEOGEN brand of anionic surfactants. In embodiments suitable anionic surfactants include NEOGEN RK available from Daiichi Kogyo Seiyaku Co. Ltd., or TAYCA POWER BN2060 from Tayca Corporation (Japan), which are branched sodium dodecyl benzene sulfonates.

Examples of cationic surfactants include ammoniums such as dialkyl benzene alkyl ammonium chloride, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, mixtures thereof, and the like. Other cationic surfactants include cetyl pyridinium bromide, halide salts of quatemized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, and the like. In embodiments a suitable cationic surfactant includes SANISOL B-50 available from Kao Corp., which is primarily a benzyl dimethyl alkonium chloride.

Exemplary nonionic surfactants include alcohols, acids, celluloses and ethers, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly (ethyleneoxy) ethanol available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. In embodiments a suitable nonionic surfactant is ANTAROX 897 available from Rhone-Poulenc Inc., which is primarily an alkyl phenol ethoxylate.

In embodiments, the resin may be prepared with initiators, such as water soluble initiators and organic soluble initiators. Exemplary water soluble initiators include ammonium and potassium persulfates which can be added in suitable amounts, such as from about 0.1 to about 8 weight percent, and in embodiments of from about 0.2 to about 5 weight percent of the monomer. Examples of organic soluble initiators include Vazo peroxides, such as VAZO 64™, 2-methyl 2-2'-azobis propanenitrile, VAZO 88™, 2-2'-azobis isobutyramide dehydrate, and mixtures thereof. Initiators can be added in suitable amounts, such as from about 0.1 to about 8 weight percent, and in embodiments of from about 0.2 to about 5 weight percent of the monomers.

Known chain transfer agents can also be utilized to control the molecular weight properties of the resin if prepared by emulsion polymerization. Examples of chain transfer agents include dodecane thiol, dodecylmercaptan, octane thiol, carbon tetrabromide, carbon tetrachloride and the like in various suitable amounts, such as from about 0.1 to about 20 percent, and in embodiments of from about 0.2 to about 10 percent by weight of the monomer.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other processes within the purview of those skilled in the art.

In embodiments, the resin may be non-crosslinked; in other embodiments, the resin may be a crosslinked polymer; in yet other embodiments, the resin may be a combination of a non-crosslinked and a crosslinked polymer. Where crosslinked, a crosslinker, such as divinyl benzene or other divinyl aromatic or divinyl acrylate or methacrylate monomers may be used in the crosslinked resin. The crosslinker may be present in an amount of from about 0.01 percent by weight to about 25 percent by weight, and in embodiments of from about 0.5 to about 15 percent by weight of the crosslinked resin.

Where present, crosslinked resin particles may be present in an amount of from about 0.1 to about 50 percent by weight, and in embodiments of from about 1 to about 20 percent by weight of the toner.

One, two, or more resins may be used. In embodiments where two or more resins are used, the resins may be in any suitable ratio (e.g., weight ratio) such as for instance about 10% (first resin)/90% (second resin) to about 90% (first resin)/10% (second resin).

In embodiments, a polyester latex can be produced through solvent-flash emulsification. Solvent-flash emulsification may be achieved by adding a solution of resin dissolved in organic solvent to an aqueous solution of surfactant and base under high-shear mixing, after which the organic solvent may be removed by distillation. Alternatively, a polyester latex can be produced through phase-inversion emulsification, in which aqueous base is slowly added to a viscous solution of resin in an organic solvent, after which the organic solvent is removed by distillation.

In embodiments, the resin may be formed by emulsion polymerization methods.

Coated Pigment

In accordance with the present disclosure, the phosphorescent pigment particles are coated by a powder coating process with the resin described above. A general process for such a coating could include, in embodiments, the following.

The phosphorescent pigment particles, which are similar in size to toner particles, may be dry blended with at least one toner resin latex as described above. The resin latex may have a particle size of from about 50 nm to about 300 nm. The dry blending applies the resin to the surface of the phosphorescent pigment particle. The dry blending may be accomplished by any mixing device suitable for blending dry powders such a Munson blender or a Littleford blender. Optionally, a bulk charge control agent (CCA) could be added. For coating in a rotary kiln, the maximum latex resin loading would be from about 1% to about 2% by weight, as a kiln has little shear to keep the particles from aggregating at high loadings. Nevertheless, this would be sufficient to modify the charging of the pigment particles so that they possess a charge similar to that possessed by a toner resin.

The pigment particle, with latex dispersed on its surface, may then be introduced into a rotary kiln, which heats and tumbles the mixture to fuse the latex onto the surface of the pigment particle. The final product includes toner sized pigment particles, which have been coated with the latex resin in an amount from about 1% to about 2% by weight of the particle, in embodiments from about 1.1% to about 1.5% by weight of the particle, the coating providing a charge similar to parent CMYK (cyan, magenta, yellow, black) toners.

Alternatively, it may be possible to use an extruder to do the heating and shearing step. Since an extruder has higher shear than a kiln, it may be utilized to apply a resin coating in an amount of from about 1% to about 20% by weight of the particle, in embodiments from about 5% to about 10% by weight of the particle, without agglomeration of the core particles. Such a process may be similar to one utilized for extrusion powder coating of carrier cores, as disclosed in U.S. Pat. Nos. 6,764,799 and 6,051,354, the entire disclosures of each of which are hereby incorporated by reference in their entirety.

In embodiments, regardless of whether a kiln, extruder, or any other mixing device is utilized, the phosphorescent pigment and resin latex may be heated to a temperature of from about 70° C. to about 300° C., in embodiments from about 100° C. to about 290° C., at a mixing rate of from about 1 revolutions per minute (rpm) to about 400 rpm, in embodiments from about 5 rpm to about 200 rpm, to form the resin coating on the phosphorescent pigment particles. The heating and shear may be applied for a period of time of from about 30 seconds to about 120 minutes, in embodiments from about 60 seconds to about 60 minutes.

Similarly, regardless of the process utilized to form the coating on the particle, the coated phosphorescent particle may possess a resin coating in an amount of from about 1% to about 20% by weight of the particle, in embodiments from about 2% to about 5% by weight of the particle.

After coating, the coated pigment can be classified as desired. The final particle may be similar in size to the pigment and may be from about 5 microns to about 50 microns in size, depending on the choice of the base pigment particle and the classification of the particles. In some embodiments, it may be desirable to have the final coated pigment similar in size to any other colored or clear toner intended for use in combination with the coated pigment. In embodiments, the coated pigment size could be tuned for xerographic considerations. In other embodiments the coated pigment size could be tuned for maximal phosphorescent emission intensity.

The resin coating on the surface of the phosphorescent pigment may provide charging performance similar to that obtained with other toners. In other embodiments, charge control additives or other surface additives could then be added and/or blended with the coated particles to provide the coated pigment particles with the final correct triboelectric charge, development transfer and cleaning properties.

The coated phosphorescent pigment of the present disclosure may have the following properties:

(1) Volume average diameter (also referred to as "volume average particle diameter") of from about 5 microns to about 50 microns, in embodiments from about 10 microns to about 30 microns, in other embodiments from about 12 microns to about 20 microns.

(2) Number Average Geometric Size Distribution (GSDn) and/or Volume Average Geometric Size Distribution (GSDv) of from about 1.05 to about 2, in embodiments from about 1.1 to about 1.4.

(3) An average circularity of from about 0.6 to about 1, in embodiments from about 0.8 to about 0.99, in embodiments from about 0.85 to about 0.95 (measured with, for example, a Sysmex FPIA 2100 analyzer).

(4) A triboelectric charge to mass ratio of from about 1 to about 50 microcoulombs per gram, in embodiments from about 2 to about 40 microcoulombs per gram.

(5) A triboelectric charge to diameter ratio of from about 0.2 to about 3 femtocoulombs per micron.

The characteristics of the phosphorescent toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of coated pigment sample, about 1 gram, may be suspended in about 200 ml of deionized water containing 6 drops of Triton X-100 surfactant and briefly sonicated. The suspension may be filtered through a 25 micrometer screen to remove any large particles that might plug the orifice of the size measurement device. The orifice should to be chosen to be large enough to accommodate the largest particles in the coated particle distribution. The sample is then put in isotonic solution to obtain a concentration of about 10%, with the sample then run in a Beckman Coulter Multisizer 3.

Additives

The toner may also include charge additives in effective amounts of, for example, from about 0.1 to about 10 weight percent of the toner, in embodiments from about 0.5 to about 7 weight percent of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, combinations thereof, and the like.

Further optional additives include any additive to enhance the properties of toner compositions. Included are surface additives, color enhancers, and the like. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Other Colors

In embodiments, the phosphorescent toners of the present disclosure may be combined with other toners to produce an image. Any other toners suitable for forming images may combined with the phosphorescent toners of the present disclosure, including those produced by conventional melt-mixing methods, emulsion aggregation methods, phase inversion methods, combinations thereof, and the like. Exemplary methods for forming emulsion aggregation toners include those disclosed in U.S. Pat. Nos. 7,507,517, 7,507,515, 7,507,513, and U.S. Patent Application Publication No. 2008/0193869, the entire disclosures of each of which are hereby incorporated by reference in their entirety.

In embodiments, for color printing, multiple colored toners may be utilized to form images. In embodiments, these toners may include pure primary colorants of cyan, magenta, yellow, and black in combination with the phosphorescent toner of the present disclosure. In other embodiments, additional colors may be utilized, including red, blue, and green, in addition to the subtractive colors of cyan, magenta, and yellow. Other colors, including white, as well as clear toners, i.e. toners possessing no colorant, may be utilized with a phosphorescent toner of the present disclosure to produce an image.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the phosphorescent toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the phosphorescent toner particles in various suitable combinations. The concentrations are may be from about 1% to about 20% by weight of the toner composition. However, different toner and carrier percentages may be used to achieve a developer composition with desired characteristics.

Imaging

The phosphorescent toners of the present disclosure can be utilized for electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

Thus, in embodiments, an electrostatographic machine could include at least one housing defining a chamber for storing a supply of toner therein, the toner including a coated phosphorescent pigment particle as described above; an advancing member for advancing the toner on a surface thereof from the chamber of the housing in a first direction toward a latent image; a transfer station for transferring toner to a substrate, the transfer station including a transfer assist member for providing substantially uniform contact between the substrate and the transfer assist member; a developer unit for developing the latent image; and a fuser member for fusing the toner to the substrate.

In some embodiments, an imaging system of the present disclosure may include five or six colors, with at least one of them being the phosphorescent toner described above. In some embodiments, the other colors may include cyan, magenta, yellow, black, white, and/or clear. Thus, in such a case, an imaging system may include a developer unit possessing five or six different housings, with a different color toner in each housing. In other embodiments, a colored toner could be combined with the phosphorescent toner described above in a single housing.

One potential issue with the phosphorescent toners produced in accordance with the present disclosure may be that, even with an extruded coating, the resin coating may at most be about 10% of the coated pigment particle, with the rest being the pigment particle itself. Thus, in some instances, these particles may not fuse well on their own. To overcome this problem, several solutions could be utilized. For example, in embodiments, the coated pigment could be put on top of a base coat. Thus, in embodiments, the coated phosphorescent pigment of the present disclosure could be developed from the $5^{th}$ housing of a 6 housing developer, with a color toner then developed from the $6^{th}$ housing (note the order is reversed as the last toner developed is closest to the paper, and thus will end up on the bottom). On fusing, the color toner and the resin on the coated pigment melt together and fuse the entire image, including the phosphorescent toner, to the paper.

Alternatively, the phosphorescent toner of the present disclosure could be developed from the $5^{th}$ housing of a 6 housing developer, and a clear toner could be developed from the $6^{th}$ housing. Again, on fusing, the clear toner and resin from the coated pigment melt together and fuse the entire image. In other embodiments, with the clear toner, the clear toner could be developed in the $5^{th}$ housing and the phosphorescent toner could be developed from the $6^{th}$ housing, if desired. Thus, in either case, the clear toner and the coated phosphorescent pigment particle may be imaged sequentially such that both the clear toner and the coated phosphorescent pigment particle are spatially proximate and effectively fixed to the imaging substrate.

In other embodiments, a clear toner and a phosphorescent toner of the present disclosure could be printed as a blend of two toners from the $5^{th}$ (or $6^{th}$) housing of a 6 housing developer. The clear toner in the blend provides additional resin to fuse the image together. If the clear/phosphorescent toner blend is printed from the $6^{th}$ housing, an additional clear toner could be developed from the $5^{th}$ housing to provide an additional protective layer on top of the phosphorescent image.

In yet other embodiments, a clear coat, such as an ultraviolet (UV) curable overcoat, could be added on top of an image to secure the phosphorescent toner to the paper. This could be in addition to a clear toner from a $5^{th}$ or $6^{th}$ housing, or a blend of clear and phosphorescent toners in the $5^{th}$ housing. Such UV overcoats are within the purview of those skilled in the art and include, for example, those disclosed in U.S. Pat. No. 6,713,222, the disclosure of which is hereby incorporated by reference in its entirety.

Applications which may benefit from the coated phosphorescent pigments of the present disclosure include printing very inexpensive, customized, glow-in-the dark stickers, labels, transfers, and posters, safety and emergency signs, and also security passes or tickets that are visible in the dark.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Preparation of a resin coated pigment. A small batch of about 40 grams of a phosphorescent pigment, commercially available as P170 SPS BLUE pigment from USR Optonix Inc., having a particle size of about 18 microns, was dry blended with about 10% of a dried amorphous latex resin of the following formula:

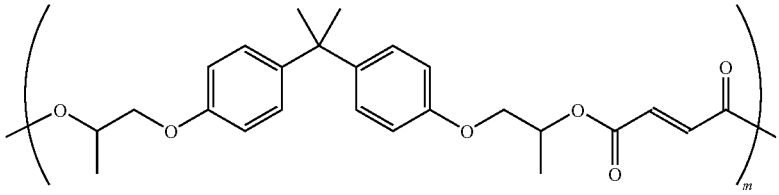

(I)

wherein m was from about 5 to about 1000, and was produced following the procedures described in U.S. Pat. No. 6,063,827, the disclosure of which is hereby incorporated by reference in its entirety. The phosphorescent pigment and the amorphous resin were combined using a high intensity powder mixer operating at about 13,500 revolutions per minute (rpm) for about 30 seconds. The mixture was then heated and extruded in a Haake mixer at about 140° C. for about 30 minutes to fuse the latex to the pigment particles.

A developer was prepared with the coated phosphorescent pigment as follows. Surface additives, including about 0.88% JMT 2000 titania from Tayca, about 1.71% RY50 silica from Evonik Industries Degussa, about 1.73% X24 sol-gel silica from Shin-Etsu Chemical Co., Ltd., about 0.55% E10 cerium oxide from Mitsui Mining, and about 0.9% UNILIN 700 wax, a functionalized polyethylene wax) from Baker Petrolite, were blended onto the surface of the latex coated particles in a second dry blending with the powder mixer operating at about 13,500 rpm for about 30 seconds, to prepare a functional toner.

The developer was then prepared by mixing the phosphorescent toner with a high-charge carrier at a concentration of about 8%. The high charge carrier was a powder coated carrier including a 35 micron ferrite core coated at about 0.8% coating weight, with a coating including about 95 parts of a dry latex of cyclohexyl methacrylate in combination with about 1% dimethylaminoethyl methacrylate (DMAEMA) as a charge control agent and about 5 parts of Vulcan XC72R carbon black from Cabot.

Toner charge was measured using a charge spectrograph. The toner charge (q/d) was measured as the midpoint of the toner charge distribution in the charge spectrograph trace. The charge was reported in millimeters of displacement from the zero line in a charge spectrograph using an applied transverse electric field of 100 volts per cm and a column length of 30 cm. The q/d measured in mm was converted to a value in femtocoulomb/micron by multiplying the value in mm by 0.092.

Developers were conditioned overnight in A and C zones at 8% toner concentration (TC) and then charged using a paint shaker for from about 5 minutes to about 60 minutes to provide information about developer stability with time and between zones. The low-humidity zone (C zone) was about 10° C./15% RH, while the high humidity zone (A zone) was about 28° C./85% RH. The results are summarized below in Table 1.

TABLE 1

| Charging data | |
|---|---|
| Zone | Peak q/d (fC/micron) |
| A-zone | 5.3 |
| C-zone | 9.5 |

Xerographic Prints. The developer was loaded into a Xerox WCP 3545 developer housing developer housing and several fused and unfused images were generated in a Xerox WCP 3545 printer commercially available from Xerox Corporation at standard electrostatic and fuser settings. The developed toner mass per unit area (TMA) of the images was about 1.3 mg/cm$^2$. The images obtained showed a solid layer of developed phosphorescent toner and exhibited a visible blue glow for a period of time of from about 20 minutes to about 30 minutes, after about 20 minutes of exposure to office fluorescent lighting. The images also glowed for several minutes after just 30 seconds under bright light.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a phosphorescent pigment particle having a size of from about 5 microns to about 50 microns;

a resin comprising an amorphous polyester in combination with a crystalline polyester, as a coating on at least a portion of a surface of the phosphorescent pigment, said resin coating being present in an amount of from about 1% to about 10% by weight of the coated phosphorescent pigment; and optionally a surface additive on at least a portion of the resin coating, wherein the phosphorescent pigment has an excitation wavelength of from about 200 nm to about 750 nm.

2. The toner according to claim 1, wherein the toner has a triboelectric charge to mass ratio of from about 1 to about 50 microcoulombs per gram.

3. The toner according to claim 1, wherein the amorphous polyester comprises a poly(propoxylated bisphenol A co-fumarate) resin of formula:

(I)

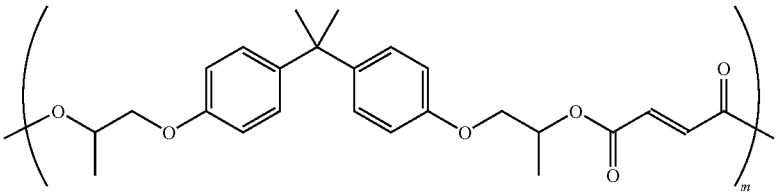

wherein m is from about 5 to about 1000.

4. The toner according to claim 1, wherein the crystalline polyester is of the following formula:

(II)

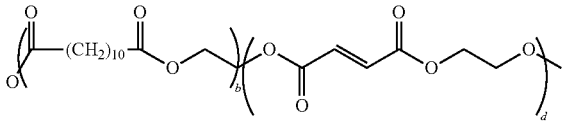

wherein b is from about 5 to about 2000 and d is from about 5 to about 2000.

5. The toner according to claim 1, wherein the phosphorescent pigment is selected from the group consisting of ZnS optionally doped with a metal selected from the group consisting of Mn, Cu, and combinations thereof, an alkaline earth aluminate optionally doped with a rare earth metal selected from the group consisting of Dy, Eu, Nd, and combinations thereof, an alkaline earth silicate optionally doped with a rare earth metal selected from the group consisting of Dy, Eu, Nd, and combinations thereof, and combinations thereof.

6. The toner according to claim 1, wherein the amorphous polyester comprises a poly(propoxylated bisphenol A co-fumarate) resin of formula:

(I)

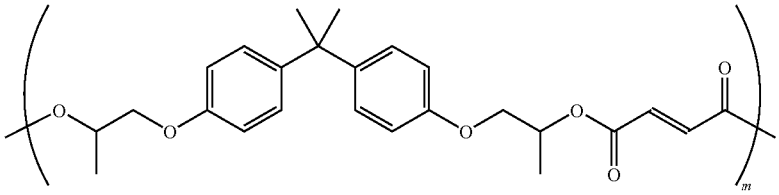

wherein m is from about 5 to about 1000, and wherein the crystalline polyester is of the following formula:

(II)

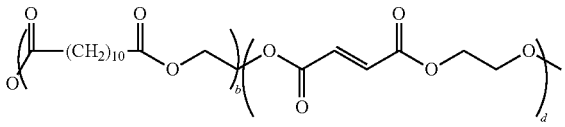

wherein b is from about 5 to about 2000 and d is from about 5 to about 2000.

7. The toner according to claim 1, wherein the surface additive comprises at least one charge control agent.

8. The toner according to claim 1, wherein the resin coated phosphorescent pigment has a size of from about 10 microns to about 40 microns and a triboelectric charge to mass ratio of from about 1 to about 50 microcoulombs per gram.

9. The toner according to claim 1, wherein the toner has a triboelectric charge to diameter ratio of from about 0.2 to about 3 femtocoulombs per micron.

10. The toner according to claim 1 wherein the phosphorescent pigment particle has a size of at least 10 microns.

11. The toner according to claim 1 wherein the phosphorescent pigment particle has a size of at least 12 microns.

12. A toner comprising:

a phosphorescent pigment particle having a size of from about 10 microns to about 40 microns;

a resin comprising an amorphous poly(propoxylated bisphenol A co-fumarate) polyester resin of formula:

(I)

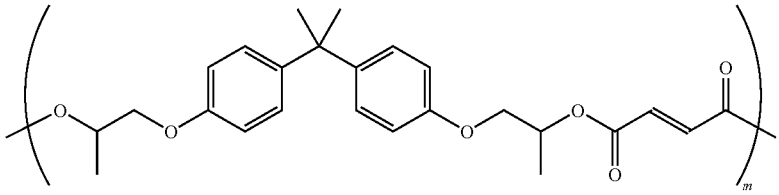

wherein m is from about 5 to about 1000, optionally in combination with a crystalline polyester, as a coating on at least a portion of a surface of the phosphorescent pigment, said resin coating being present in an amount of from about 1% to about 10% by weight of the coated phosphorescent pigment; and optionally a surface additive on at least a portion of the resin coating, wherein the phosphorescent pigment has an excitation wavelength of from about 200 nm to about 750 nm.

13. The toner according to claim 12, wherein the phosphorescent pigment is selected from the group consisting of ZnS optionally doped with a metal selected from the group consisting of Mn, Cu, and combinations thereof, an alkaline earth aluminate optionally doped with a rare earth metal selected from the group consisting of Dy, Eu, Nd, and combinations thereof, an alkaline earth silicate optionally doped with a rare earth metal selected from the group consisting of Dy, Eu, Nd, and combinations thereof, and combinations thereof.

14. The toner according to claim 12, wherein the crystalline polyester is of the following formula:

(II)

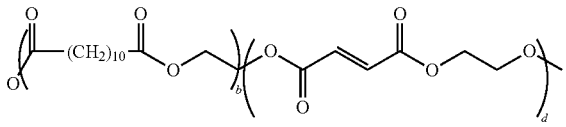

wherein b is from about 5 to about 2000 and d is from about 5 to about 2000, wherein the toner has a triboelectric charge to mass ratio of from about 1 to about 50 microcoulombs per gram.

15. A two-component developer composition comprising:

(a) a toner which comprises:

(1) a phosphorescent pigment particle having a size of from about 5 microns to about 50 microns;

(2) a resin coating on at least a portion of a surface of the phosphorescent pigment, said resin coating being present in an amount of from about 1% to about 10% by weight of the coated phosphorescent pigment; and (3) optionally a surface additive on at least a portion of the resin coating, wherein the phosphorescent pigment has an excitation wavelength of from about 200 nm to about 750 nm; and (b) carrier particles.

16. The developer according to claim 15 wherein the carrier particles comprise granular zircon, granular silicon, glass, steel, nickel, ferrites, iron ferrites, silicon dioxide, or mixtures thereof.

17. The developer according to claim 15 wherein the carrier particles include a core with a polymeric coating thereover.

18. The developer according to claim 15 wherein the phosphorescent pigment is selected from the group consisting of ZnS optionally doped with a metal selected from the group consisting of Mn, Cu, and combinations thereof, an alkaline earth aluminate optionally doped with a rare earth metal selected from the group consisting of Dy, Eu, Nd, and combinations thereof, an alkaline earth silicate optionally doped with a rare earth metal selected from the group consisting of Dy, Eu, Nd, and combinations thereof, and combinations thereof.

19. The developer according to claim 15 wherein the resin comprises an amorphous polyester comprising a poly(propoxylated bisphenol A co-fumarate) resin of formula:

(I)

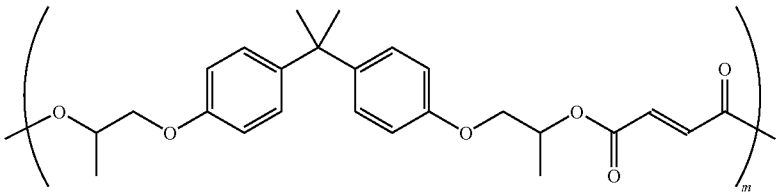

wherein m is from about 5 to about 1000.

20. The developer according to claim 15 wherein the resin comprises a crystalline polyester is of the following formula:

(II)
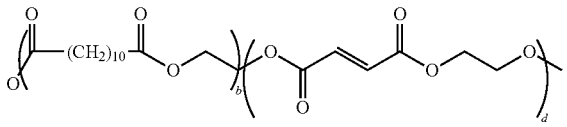
wherein b is from about 5 to about 2000 and d is from about 5 to about 2000.
* * * * *